United States Patent [19]

Dallaire

[11] 4,262,451

[45] Apr. 21, 1981

[54] ROLLER ASSEMBLY FOR A SLIDING FRAME CLOSURE

[75] Inventor: Raymond Dallaire, P.O. Box 220 Levis, Que., Canada

[73] Assignee: P.H.-Tech, Inc., Quebec, Canada

[21] Appl. No.: 33,848

[22] Filed: Apr. 27, 1979

[30] Foreign Application Priority Data

Mar. 16, 1979 [CA] Canada ..... 323602

[51] Int. Cl.[3] ..... E05D 13/02

[52] U.S. Cl. ..... 49/425; 16/99; 16/105

[58] Field of Search ..... 49/425, 420; 16/97, 16/98, 99, 105

[56] References Cited

U.S. PATENT DOCUMENTS

| | | | |
|---|---|---|---|
| 3,237,238 | 3/1966 | Anderson | 49/425 X |
| 3,283,444 | 11/1966 | Andres | 49/420 |
| 3,298,136 | 1/1967 | Saunders | 49/425 |
| 3,341,973 | 9/1967 | Miller | 49/420 |
| 3,670,357 | 6/1972 | Steigerwald | 49/425 X |
| 3,784,784 | 7/1973 | Smits | 49/425 |
| 3,826,044 | 7/1974 | Armstrong | 49/420 |
| 4,126,912 | 11/1978 | Johnson | 49/425 X |

FOREIGN PATENT DOCUMENTS

| | | | |
|---|---|---|---|
| 75305 | 2/1967 | Canada | 49/425 |
| 2437554 | 2/1976 | Fed. Rep. of Germany | 16/97 |

*Primary Examiner*—Philip C. Kannan
*Attorney, Agent, or Firm*—Howson & Howson

[57] ABSTRACT

There is described a roller assembly which is adapted to be snapped into and out of a channel of a sliding frame closure which device is used to adjust the effective height of the closure relative to an aperture frame in which it is installed. The roller assembly or device comprises an outer stationary frame member having a pair of correspondingly positioned canted slots formed therein and means provided on the outer frame member to permit frictional and mechanical engagement of the assembly within the channel of the sliding frame closure; an inner frame member adapted to be mounted within the outer frame member and having at least one roller wheel fixedly mounted therein for rotation about its axis; the inner frame member being mounted for vertical movement within the outer frame member by means of a transverse pin which extends through the canted slots of the outer frame member; the inner frame member being secured by adjustment means to the outer frame member such that on tightening of the adjustment means, the transverse pin secured through the inner frame member slides down the canted slot moving the roller wheel vertically downward and reverse movement occurs on loosening of the adjustment means. Also described is the combination of at least one of the roller assemblies and a sliding frame closure.

7 Claims, 6 Drawing Figures

ROLLER ASSEMBLY FOR A SLIDING FRAME CLOSURE

This invention relates to a roller assembly which is adapted to be snapped into and out of a channel of a sliding frame closure, e.g., door and window type closures, and is used to adjust the effective height of the closure relative to an aperture frame in which it is installed.

Roller devices are known which can be removed from the closure and thus can be replaced when damaged or worn out. Usually, these devices have been fixedly mounted within a bottom channel of the sliding frame closure by screw means or the like. An example of such a device is found in U.S. Pat. No. 3,670,357 issued June 20, 1972 to Steigerwald. In the prior art devices, generally vibration loads are transmitted to the roller assemblies and thus to the screw means holding the assemblies to the frame. This vibration tends to loosen the screw mountings which consequently results in increased wear of the roller assemblies since this loosening can change their load bearing positions from their predetermined optimum points.

Further, since it is desirable that removal and substitution of the roller assembly be accomplished quickly with a minimum of skill and equipment, there is a need to provide a roller assembly of simple, yet durable construction which is economical to manufacture and which can be readily mounted and dismounted from the frame of the sliding closure.

Thus, the present invention provides a roller assembly adapted to be snapped into and out of a channel of a sliding frame closure, which comprises an outer stationary frame member having a pair of correspondingly positioned canted slots formed therein and means provided on the outer frame member to permit frictional and mechanical engagement of the assembly within the channel of the sliding frame closure; an inner frame member adapted to be mounted within the outer frame member and having at least one roller wheel fixedly mounted therein for rotation about its axis; the inner frame member being mounted for vertical movement within the outer frame member by means of a transverse pin which extends through the canted slots of the outer frame member; the inner member being secured by adjustment means to the outer frame member such that on tightening of the adjustment means, the transverse pin secured through the inner frame member slides down the canted slot moving the roller wheel vertically downward and reverse movement occurs on loosening of the adjustment means.

More particularly, the outer frame member can comprise a pair of parallel side walls joined by an end wall, each side wall having a correspondingly positioned canted slot formed therein; and the inner frame member can comprise two sections; a first section comprising a pair of parallel side walls within which a pair of roller wheels are fixedly mounted in tandem for rotation about their axes and the second section comprising a pair of parallel side walls joined by an end wall, the side walls being adapted to receive a portion of the side walls of the second section, the two sections of the inner frame member being joined together and mounted for vertical movement within the outer frame member by means of a transverse pin which extends through the canted slots of the outer frame member; the end wall of the second section being secured by adjustment means to the end wall of the outer frame member such that on tightening of the adjustment means, the end wall of the inner frame member moves towards the end wall of the outer frame member and the transverse pin secured through the inner frame member slides down the canted slot moving the roller wheels vertically downward and reverse movement occurs on loosening of the adjustment means.

Preferably, the frictional and mechanical engagement means of the roller assembly comprises at least one of the following; one or more protuberances on each outer side surface of the outer stationary frame member which are adapted to be snapped over the rested against a resilient ridge located on each side wall of a channel in the frame of the sliding closure, whereby on installation of the assembly within the channel, downward vertical movement of the outer stationary frame member relative to the closure frame is prevented; the outer dimensions of the outer stationary frame member of the assembly being selected to permit the member to fit into a socket of corresponding dimensions formed in the channel whereby on installation of the assembly within the channel, longitudinal and transverse movement of the outer stationary frame member relative to the closure frame is prevented; and a slot provided in a top portion of the outer stationary frame member which on installation of the assembly within the channel engages in a tongue and groove-like manner with a longitudinal bead formed in the base of the channel whereby downward vertical movement of the outer stationary frame member relative to the closure frame is prevented.

More preferably, the frictional and mechanical engagement means of the roller assembly comprises the following: one or more protuberances on each of the side walls of the outer stationary frame member which are adapted to be snapped over and rested against a resilient ridge located on each side wall of the channel in the frame of the sliding closure, whereby on installation of the assembly within the channel, downward vertical movement of the outer stationary frame member relative to the closure frame is prevented; the outer dimensions of the outer stationary frame member is selected to permit the member to fit into a socket of corresponding dimensions formed in the channel whereby on installation of the assembly within the channel, longitudinal and transverse movement of the assembly relative to the closure frame is prevented; and a slot is provided in a top portion of the outer stationary frame member which on installation of the assembly within the channel engages in a tongue and groove-like manner a longitudinal bead formed in the base of the channel, whereby downward vertical movement of the outer stationary frame member relative to the closure frame is prevented.

In another aspect, the invention also provides in combination at least one of the above roller assemblies and a sliding frame closure having a top and a bottom channel, each of which is provided with frictional and mechanical engagement means to cooperate with the frictional and mechanical engagement means provided on the outer frame member, the assembly being mounted within the bottom channel of the closure so that the roller wheels can slidingly engage a track located at the base of a door and window aperture and height adjustment of the closure is effected by the adjustment means of the roller assembly.

Preferably, two roller assemblies are mounted in the bottom channel of the sliding frame closure, one at each corner.

In its more preferred form, the combination includes cooperating frictional and mechanical means which comprises at least one of the following: one or more protuberances on each outer side surface of the outer stationary member which are snapped over and rest against a resilient ridge, one being located on each side wall of the channel whereby downward vertical movement of the outer stationary frame member relative to the closure frame is prevented; the outer stationary frame member is fitted into a socket of corresponding dimensions formed in the channel, whereby longitudinal and transverse movement of the outer stationary frame member relative to the frame is prevented; and the slot provided in the top portion of the outer stationary frame member is engaged in a tongue and groove-like manner with the longitudinal bead formed in the base of the channel whereby downward vertical movement of the outer stationary frame member relative to the closure frame is prevented.

Another preferred form for the combination includes cooperating frictional and mechanical means comprising the following: one or more protuberances on each of the side walls of the outer stationary frame member which are snapped over and rest against a resilient ridge located on each sidewall of the channel, whereby downward vertical movement of the outer stationary frame member relative to the closure frame is prevented; the outer stationary frame member is fitted into a socket of corresponding dimensions formed in the channel, whereby longitudinal and transverse movement of the outer stationary frame member relative to the closure frame is prevented; and the slot provided in the top portion of the outer stationary frame member is engaged in a tongue and groove-like manner with the longitudinal bead formed in the base of the channel whereby downward vertical movement of the outer stationary frame member relative to the closure frame is prevented.

Thus, the assembly of the present invention can rapidly and easily be snapped into and out of the sliding frame closure. The assembly remains secure within the frame and yet does not require the use of any additional securing means, such as screws or the like.

Since each end of the sliding frame closure is provided with a channel to receive the roller assemblies, and the roller assemblies are mounted in the bottom channel of the closure only, it is possible to provide either left or right hand sliding closures by merely altering the position of the roller assemblies from one channel to the other channel.

Preferably, the roller assembly is formed of a hardened steel which is more perferably treated to be rust resistant. Obviously, other materials can be used, but the actual choice is governed by the load-bearing requirements of the assembly and the manufacturing costs.

The sliding frame closures can be formed of a variety of materials, one frequent choice is a fairly rigid foam-filled vinyl plastic material, although other conventional materials can be used. All of the mating portions of the channel which cooperate with those portions of the roller assembly to ensure that the assembly can be snapped into and out of the frame member are integrally formed with the closure frame member. Thus the ridges formed on the inside walls of the channels do provide the required degree of flexibility or resiliency and thus permit the protuberances on the outer surfaces of the outer stationary frame member to snap over them and the same can be said of the longitudinal bead.

To ensure smooth operation and avoid cocking of the sliding frame closure, two of the roller assemblies should be employed, one being located as close to the end of each lower corner of the frame closure as possible. This arrangement also permits ready access to the adjustment means, usually a nut and bolt arrangement which controls the effective height of the closure within the aperture in which it is mounted. Obviously, access is important once the sliding closure has been mounted within the aperture wherein it is employed.

The present invention will be more readily understood by reference to the accompanying drawings wherein there is illustrated one embodiment thereof.

Figure 5:
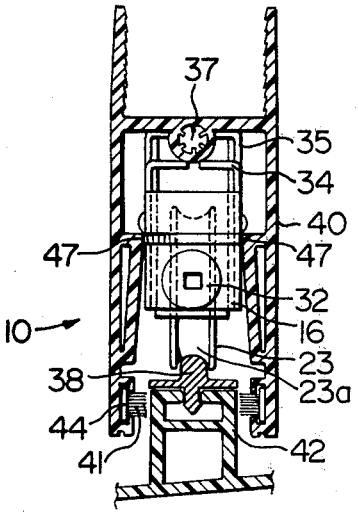
FIG. 5 is a section on line 5—5 of FIG. 2.
Figure 6:
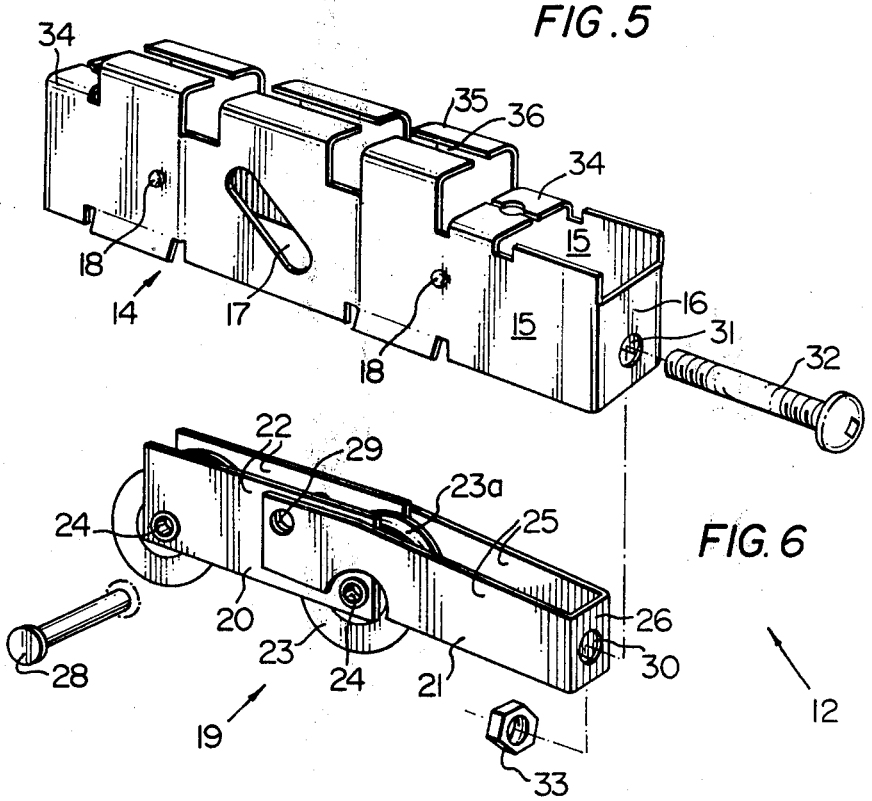
FIG. 6 is an exploded view in perspective of a roller assembly.

Referring first to FIG. 6 of the drawings, there is shown an exploded perspective view of a roller assembly designated generally at 12. An outer stationary frame member designated generally at 14 comprises a pair of side walls 15 joined by an end wall 16. The outer stationary frame member 14 also includes an upper top portion 35 in which a longitudinal slot 36 is formed, and a lower top portion 34. Each of side walls 15 is provided on its outer surface with a pair of protuberances 18 and a correspondingly positioned canted slot 17 is formed in each side wall 15. The end wall 16 is provided with an aperture 31 sized to receive a screw-threaded bolt 32. An inner frame member designated generally at 19 is sized for mounting within outer frame member 14. The inner frame member 19 comprises sections 20 and 21. Section 20 consists of a pair of parallel side walls 22, between which are tandemly mounted on bearings (not shown) for rotational movement about their axles 24, roller wheels 23. The wheels 23 are each provided with a semi-circular shape groove **23*a* for engaging a top edge of a track 38 mounted in a track support 42 (see FIG. 5). Section 21 consists of a pair of parallel side walls 25 joined by an end wall 26. The side walls 25 of section 21 overlap the side walls of section 20, and each set of side walls is provided with mating apertures 29. A pin or the like 28 is fitted through the canted slots 17, through the mating apertures 29 of the sections 20 and 21, permitting pivotal movement between the sections and mounting the inner frame member 19 for vertical movement within the outer frame member 14. At the same time, side walls 25 are provided with semi-circular cut-outs 27 which fit over either end of the axle 24 of one of the wheels 23 to allow movement of the section 20 relative to section 21 when the inner frame member 19 is mounted within the outer frame member 14**.

End wall 26 is also provided with an aperture 30 sized to receive threaded bolt 32. A mating nut 33 is provided for bolt 32, the outer dimensions of which are chosen to prevent rotational movement thereof within the side walls 25 of section 21. When the inner frame member 19 is mounted within the outer frame member, bolt 32 and nut 33 extend through apertures 30 and 31, thereby connecting the inner frame member 19 to the outer frame member 14 and providing an adjustment means which provides for effective height adjustment of the sliding frame closure 10 when mounted in a window or door aperture 11 (see FIG. 1).

Figure 2:
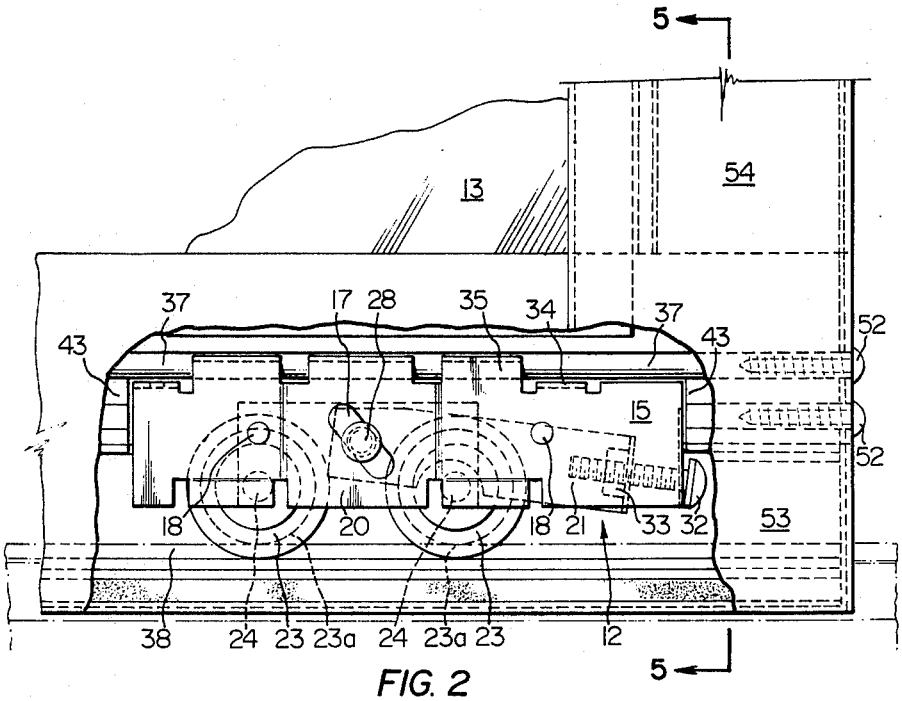
FIG. 2 is a front view of the bottom right-hand corner of the sliding frame closure of FIG. 1 with a portion of the frame cut away to show one of the roller assemblies.
Figure 4:
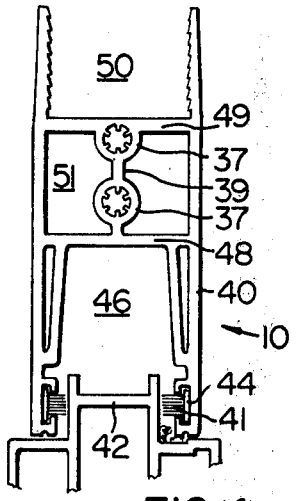
FIG. 4 is an end view of the sliding frame closure without the roller assembly.

Referring now to FIGS. 4 and 5 of the drawings, there is shown an end view of a sliding frame closure designated generally at 10. The frame is extrusion molded of a fairly rigid foam-filled vinyl. In the extrusion process, the frame is provided with a channel 40 in which longitudinal channels 46, 50 and 51 are formed. Channel 46 is formed so that its bottom inside edges are provided with longitudinal slots 44 which are adapted to receive weather stripping 41 which ensures that dust, debris and moisture are prevented from entering the channel 46. Channel 50 receives a glass or screen 13 of the closure while channel 51 is provided with two parallel, hollow, tubular portions 37 connected together by a web 39 and one atop the other, which portions at each end of the frame receive screws 52 (see FIG. 2) which hold the horizontal 53 and vertical 54 frame sections of the sliding closure 10 together.

Transverse connecting walls 48 and 49 join together, space and support the frame walls 52 and form the channels 50, 51 and 46.

The walls of channel 46 are inwardly inclined towards transverse connecting wall 48. A slot 43 (see FIG. 2) is cut in the form of a size to receive the roller assembly 12. Wall 48 and the lower hollow tubular portion 37 are cut out in each slot 43. The length of wall 48 matches the length of the roller assembly while the length cut out from the lower hollow tubular portion 37 matches the length of the slot 36 formed in the upper top portion 35 of the outer stationary frame member 14. The top edge 47 of each of the inclined walls of channel 46 form ridges over which the protuberances 18 provided on the exterior surfaces of the outer stationary frame member 14 can snap when a roller assembly 12 is inserted into slot 43. At the same time, the slot 36 in the top of the outer frame member 14 snaps over the lower hollow tubular portion 37. When these cooperating members are joined as has been described, the roller assembly is fixedly mounted within the frame of the sliding frame closure and any laterial or longitudinal or vertical displacement of the outer stationary frame member 12 relative to the closure frame 10 is prevented. At the same time, because of the frictional and mechanical engagement between the outer frame member and the hollow frame portion of the sliding closure, the roller assembly can be readily removed by a simple prying tool.

Figure 1:
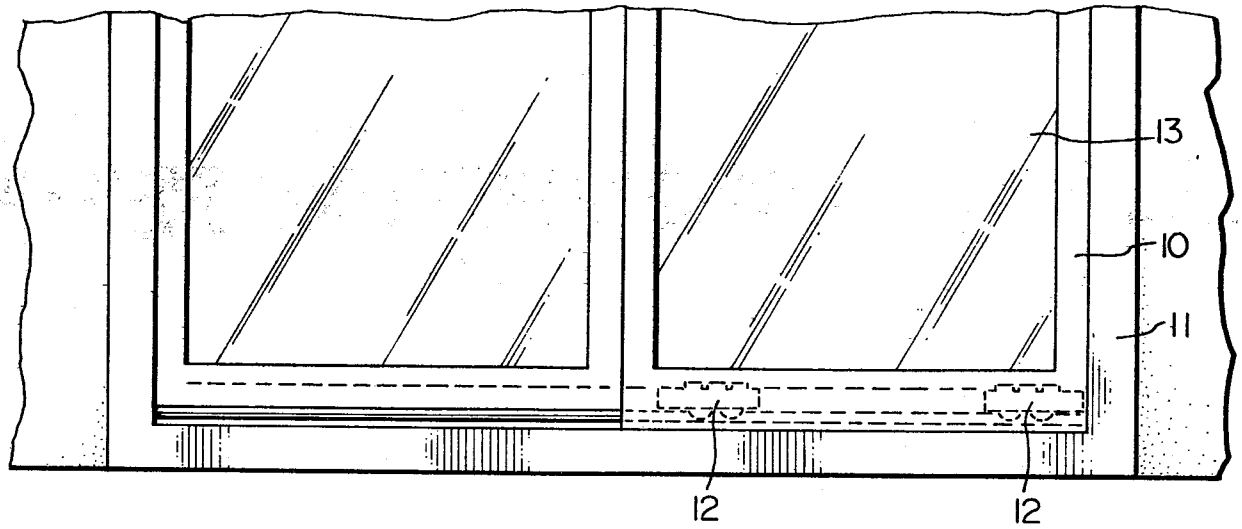
FIG. 1 is a front view of a portion of a bottom of a sliding frame closure with two roller assemblies shown in phantom.
Figure 3:
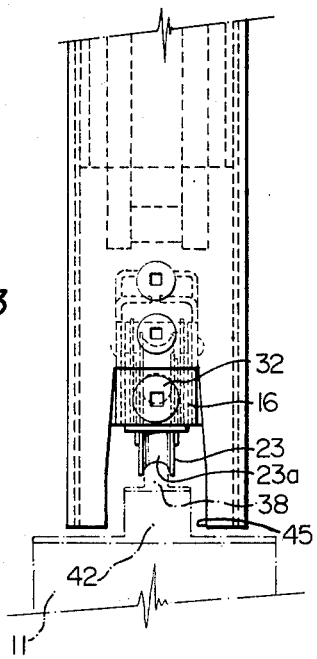
FIG. 3 is an end view of the corner of the sliding frame closure seen in FIG. 2.

As was stated earlier, to ensure smooth operation of a sliding closure and to prevent cocking thereof, it is necessary that a roller assembly be mounted at a position as near as possible the corner in a bottom channel of a sliding frame closure (see FIG. 1). This ensures access to the adjustment bolt 32 from the end of the sliding closure. Reference should be made to FIG. 3 wherein there is shown an opening 45 on the side end of the sliding frame closure which opening permits access to the longitudinal adjustment screw 32 by the means of a screw driver or other such device (not shown), when the closure is mounted within a door or window aperture 11.

On tightening of the bolt 32, the roller wheels move vertically downwardly, while on loosening of the bolt, the reverse is true. Thus, to mount a sliding frame closure within an aperture, the bolt 32 is loosened and once fitted within the aperture with the roller wheels engaged on the top edge 38, adjustment of the bolt 32, i.e., tightening thereof, moves the roller wheels downward vertically providing a snug fit of the sliding frame closure within the aperture.

The embodiments of the invention in which an exclusive property or privilege is claimed are defined as follows:

1. A roller assembly comprising:

an outer frame member comprising a first pair of side walls and a first end wall joining said first pair of side walls together, each of said first pair of side walls having a canted slot formed therein, said slots being correspondingly positioned in their respective side walls;

an inner frame member within said outer frame member, comprising a first section and a second section, said first section comprising a second pair of parallel side walls and a pair of roller wheels mounted thereon in tandem for rotation about their respective axes, said second section comprising a third pair of side walls and a second end wall joining them together, said third pair of side walls of said second section receiving overlapping portions of said second pair of side walls of said first section;

a transverse pin extending through said third pair of side walls and said overlapping portions of said second pair of side walls and into said slots, for joining together said first and second sections of said inner frame member and for mounting said inner frame member in a position within said outer frame member which is adjustable inwardly and outwardly with respect to said outer frame member by diagonal sliding motion of said pin in said slots; and adjustment means securing said first end wall of said outer frame member to said second end wall of said second section so that upon tightening of said adjustment means said end wall of said second section moves toward said first end wall of said outer frame member and said transverse pin slides down said canted slots, moving said roller wheels downwardly, and upon loosening of said adjustment means said roller wheels are moved upwardly.

2. The combination with the roller assembly of claim 1 of a sliding frame closure, said sliding frame closure having an edge channel therein within which said roller assembly is positioned, and cooperating frictional and mechanical engagement means for retaining said roller assembly within said channel so that said roller wheels can engage a track located in a door or window aperture and adjustment of the position of said closure in said aperture can be effected by said adjustment means of said roller assembly.

3. The combination of claim 2, wherein two roller assemblies each as claimed in claim 1 are present, one at each opposite corner of a bottom edge channel of said sliding frame closure.

4. The combination of claim 2 or claim 3, wherein said first pair of side walls each has protuberances on the outer side surface thereof and said sliding frame closure comprises a pair of resilient ridges located at opposite interior sides of said channel, said protuberances being adapted to be snapped over and rested on said ridges when said outer frame member is urged into said channel, thereby to restrain said outer frame member against outward movement with respect to said channel.

5. The combination of claim 2 or claim 3, wherein said outer frame member is sized to fit snugly into said channel thereby to restrain it against sliding motion with respect to said channel.

6. The combination of claim 2 or claim 3, wherein said channel comprises a longitudinal bead extending along the base of said channel, said outer frame member having a longitudinally-extending slot along the top thereof, said slot engaging said bead in tongue-in-groove-like manner to restrain outward movement of said outer frame member with respect to said channel.

7. The combination of claim 2 or claim 3, wherein: said first pair of side walls each has protuberances on the outer side surface thereof and said sliding frame closure comprises a pair of resilient ridges located at opposite interior sides of said channel, said protuberances being adapted to be snapped over and rested on said ridges when said outer frame member is urged into said channel thereby to restrain said outer frame member against outward movement with respect to said channel; said outer frame member is sized to fit snugly into said channel thereby to restrain it against sliding motion with respect to said channel; said channel comprising a longitudinal bead extending along the base of said channel, said outer frame member having a longitudinally-extending slot along the top thereof, said slot engaging said bead in tongue-in-groove-like manner to restrain outward movement of said outer frame member with respect to said channel.

* * * * *